US011345454B2

(12) United States Patent
Harada et al.

(10) Patent No.: US 11,345,454 B2
(45) Date of Patent: May 31, 2022

(54) OUTBOARD MOTOR

(71) Applicant: HONDA MOTOR CO., LTD., Tokyo (JP)

(72) Inventors: Yoshihiro Harada, Saitama (JP); Hiroshi Yamamoto, Saitama (JP); Akifumi Fujima, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/043,890

(22) PCT Filed: Mar. 30, 2018

(86) PCT No.: PCT/JP2018/013824
§ 371 (c)(1),
(2) Date: Sep. 30, 2020

(87) PCT Pub. No.: WO2019/187075
PCT Pub. Date: Oct. 3, 2019

(65) Prior Publication Data

US 2021/0053663 A1 Feb. 25, 2021

(51) Int. Cl.

| | |
|---|---|
| ***B63H 20/08*** | (2006.01) |
| ***B63H 1/14*** | (2006.01) |
| ***B63H 25/42*** | (2006.01) |

(52) U.S. Cl.
CPC ..... *B63H 20/08* (2013.01); *B63H 1/14* (2013.01); *B63H 25/42* (2013.01); *B63H 2025/425* (2013.01)

(58) Field of Classification Search
CPC ..... B63H 20/08; B63H 1/14; B63H 25/42; B63H 2025/425
See application file for complete search history.

(56) References Cited

U.S. PATENT DOCUMENTS 9,017,118 B1 * 4/2015 Pfiffner ..... B63H 20/14 440/75
2004/0162649 A1 8/2004 Takada et al.
(Continued)

FOREIGN PATENT DOCUMENTS

JP 2001-146384 A 5/2001
JP 2002-318416 A 10/2002
(Continued)

OTHER PUBLICATIONS

Jun. 19, 2018, International Search Report issued for related PCT application No. PCT/JP2018/013824.
(Continued)

*Primary Examiner* — Stephen P Avila
(74) *Attorney, Agent, or Firm* — Paratus Law Group, PLLC

(57) ABSTRACT

An outboard motor includes: an outboard motor body including a propeller driven by an internal combustion engine; a mounting portion configured to mount the outboard motor body to a hull so as to be movable relative to the hull; and an operation mechanism provided between the outboard motor body and the mounting portion and configured to adjust a relative position of the outboard motor body with respect to the hull. The operation mechanism is a link-type operation mechanism including a hydraulic cylinder as an actuator.

3 Claims, 5 Drawing Sheets

(56) References Cited

U.S. PATENT DOCUMENTS

| | | | |
|---|---|---|---|
| 2010/0173543 | A1 | 7/2010 | Inaba |
| 2017/0043853 | A1 | 2/2017 | Komoda et al. |
| 2017/0355432 | A1 | 12/2017 | Mizutani |

FOREIGN PATENT DOCUMENTS

| | | | |
|---|---|---|---|
| JP | 2004-249792 | A | 9/2004 |
| JP | 2007-290644 | A | 11/2007 |
| JP | 2010-158926 | A | 7/2010 |
| JP | 2015-205534 | A | 11/2015 |
| JP | 2017-222218 | A | 12/2017 |

OTHER PUBLICATIONS

Jun. 19, 2018, International Search Opinion issued for related PCT application No. PCT/JP2018/013824.

* cited by examiner

OUTBOARD MOTOR

CROSS REFERENCE TO PRIOR APPLICATION

This application is a National Stage Patent Application of PCT International Patent Application No. PCT/JP2018/013824 (filed on Mar. 30, 2018) under 35 U.S.C. § 371, which is hereby incorporated by reference in its entirety.

TECHNICAL FIELD

The present invention relates to an outboard motor.

BACKGROUND ART

In general, an outboard motor includes a power tilt-trim unit that adjusts a tilt angle and a trim angle of an outboard motor body with respect to a hull. Some power tilt-trim units include one hydraulic cylinder for adjusting the tilt angle and two hydraulic cylinders for adjusting the trim angle (see, for example, Patent Literature 1).

RELATED ART REFERENCE

Patent Document

Patent Document 1: JP-A-2004-249792

SUMMARY OF INVENTION

Technical Problem

In Patent Document 1, there is a problem that the number of hydraulic cylinders is large and a control for adjusting the tilt angle and trim angle (hereinafter referred to as a tilt trim angle) of the outboard motor body becomes complicated.

The present invention provides an outboard motor that can reduce the number of actuators in an operation mechanism configured to adjust a relative position of an outboard motor body with respect to a hull.

Solution to Problem

According to the present invention, there is provided an outboard motor including:

an outboard motor body including a propeller driven by an internal combustion engine;

a mounting portion configured to mount the outboard motor body to a hull so as to be movable relative to the hull; and an operation mechanism provided between the outboard motor body and the mounting portion and configured to adjust a relative position of the outboard motor body with respect to the hull, wherein the operation mechanism is a link-type operation mechanism including an actuator.

Advantageous Effects of Invention

According to the present invention, since the operation mechanism configured to adjust the relative position of the outboard motor body with respect to the hull is a link-type operation mechanism, the number of actuators can be reduced.

DESCRIPTION OF EMBODIMENTS

A boat equipped with an outboard motor according to an embodiment of the present invention will be described below with reference to the accompanying drawings.

Figure 1:
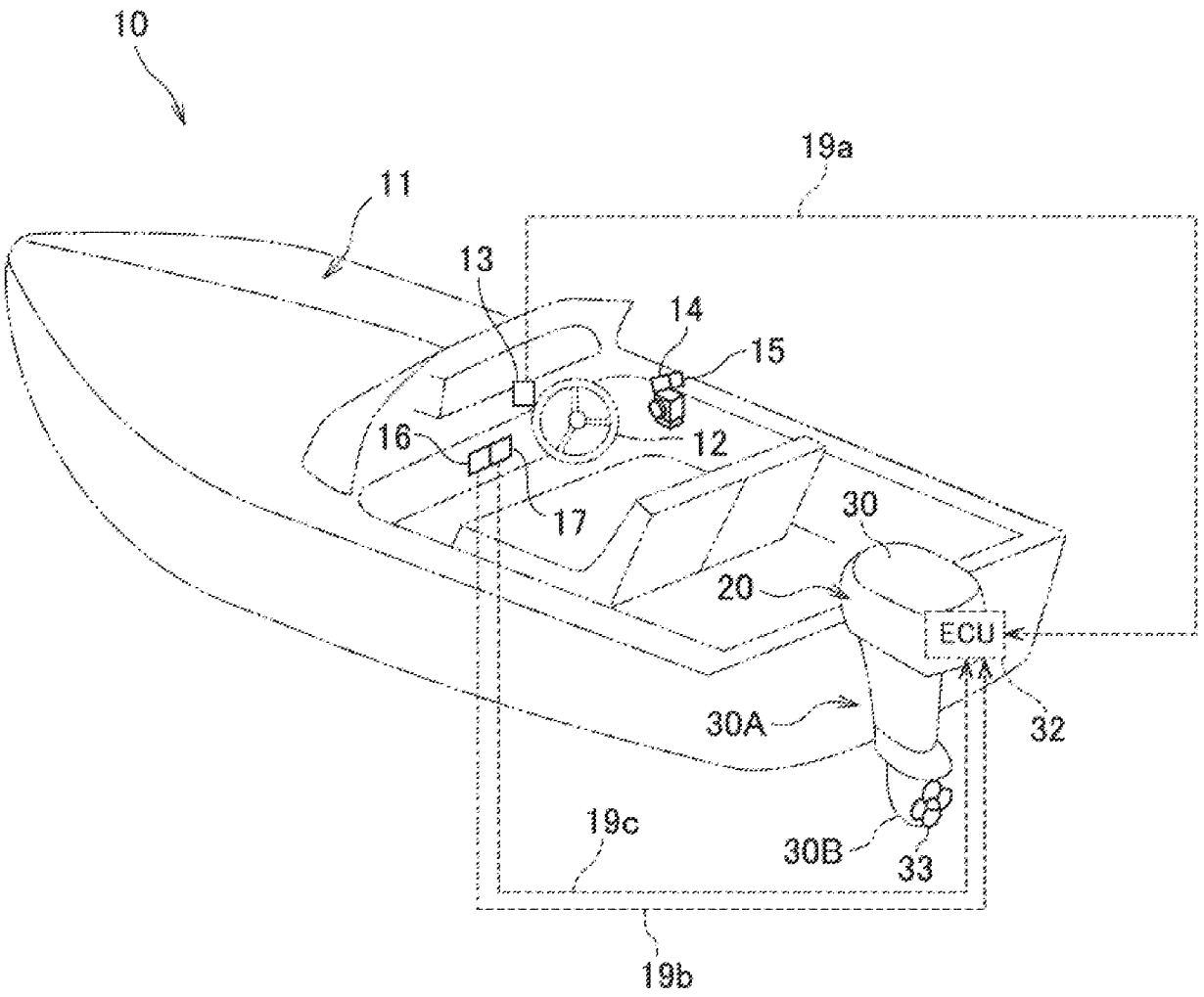
FIG. 1 is a perspective view of a boat including an outboard motor according to an embodiment of the present invention.

A boat 10 shown in FIG. 1 includes an outboard motor 20 at a rear end of a hull 11. A steering wheel 12 is provided in the vicinity of an operator's seat of the hull 11. A steering angle sensor 13 is provided in the vicinity of the steering wheel 12. The steering angle sensor 13 outputs a signal corresponding to a steering angle of the steering wheel 12. In addition, a throttle lever 14 and a shift lever 15 are disposed on a right side of the operator's seat, and these operations are transmitted to a throttle valve and a shift mechanism (both not shown) of the outboard motor 20 via a push-pull cable (not shown).

Further, a power tilt switch 16 and a power trim switch 17 are disposed in the vicinity of the operator's seat. The power tilt switch 16 outputs a signal corresponding to a tilt up and/or tilt down operation. The power trim switch 17 outputs a signal corresponding to a trim up and/or trim down operation. The outputs of the steering angle sensor 13, the power tilt switch 16, and the power trim switch 17 are sent to the outboard motor 20 via signal lines 19*a*, 19*b*, and 19*c*.

Figure 2:
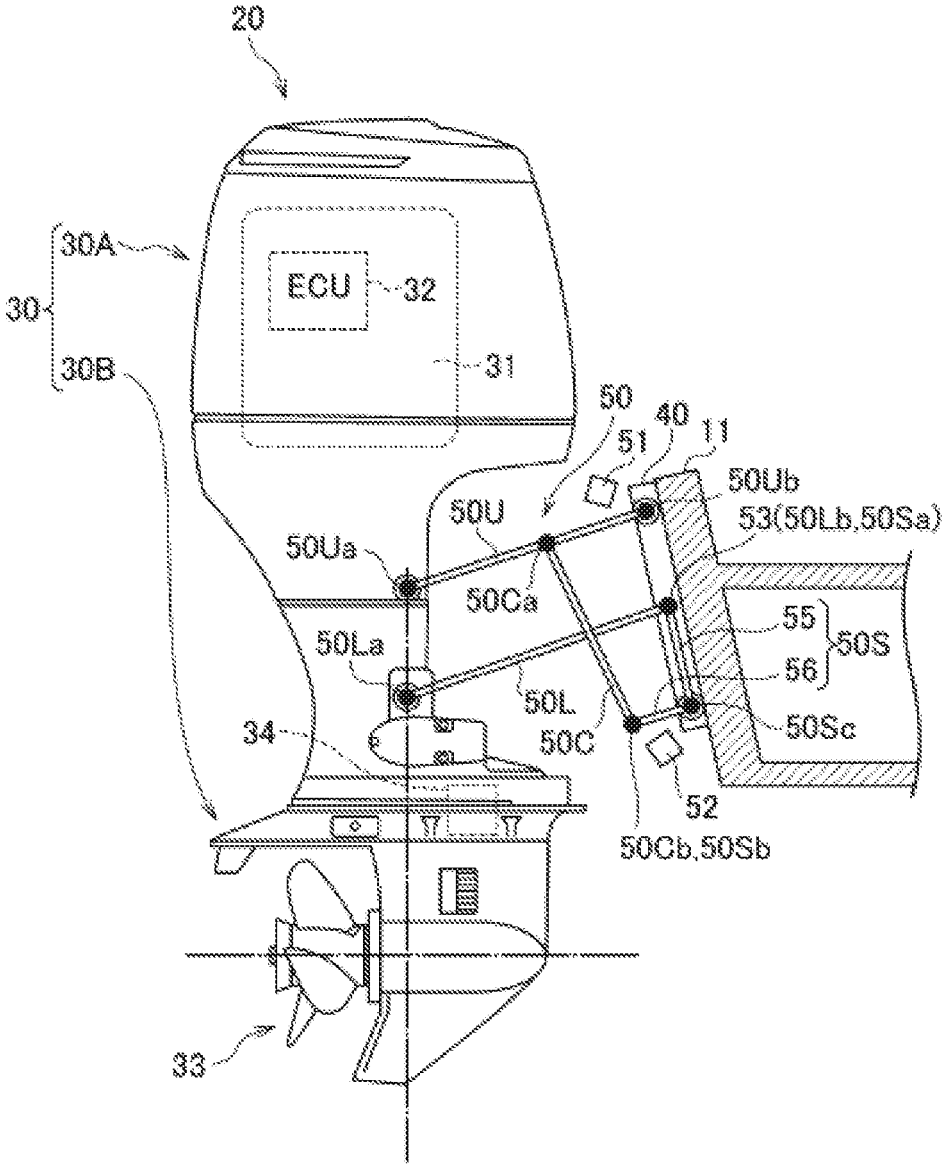
FIG. 2 is a side view of the outboard motor according to the embodiment of the present invention in a full tilt-down state.

As shown in FIG. 2, the outboard motor 20 includes an outboard motor body 30, a mounting portion 40 for mounting the outboard motor body 30 to the hull 11 so as to be movable relative to the hull 11, and an operation mechanism 50 provided between the outboard motor body 30 and the mounting portion 40 and configured to adjust a relative position of the outboard motor body 30 with respect to the hull 11.

The outboard motor body 30 includes a main body portion 30A connected to the hull 11 via the operation mechanism 50 and the mounting portion 40, and a rudder portion 30B connected to a lower end of the main body portion 30A so as to be able to turn. The main body portion 30A is mainly located above a water surface, and the rudder portion 30B is mainly located below the water surface.

The main body portion 30A is provided with an internal combustion engine 31 and an electronic control unit (hereinafter referred to as ECU) 32. The ECU 32 controls a steering angle, a tilt trim angle, or the like of the outboard motor body 30 based on signals transmitted from the hull 11 side via the signal lines 19*a*, 19*b*, and 19*c*.

The rudder portion 30B includes a propeller 33 that generates a propulsive force. Power of the internal combustion engine 31 is transmitted to the propeller 33 via a crankshaft, a drive shaft, a gear mechanism, and a shift mechanism (not shown).

A propeller position adjustment mechanism 34 is built in the main body portion 30A. By operating the propeller position adjustment mechanism 34, the rudder portion 30B can be turned (rotated) relative to the main body portion 30A, and a direction of the propeller 33 with respect to the main body portion 30A can be changed together with the rudder portion 30B. With this configuration, the direction (relative position) of the propeller 33 with respect to the hull 11 can be adjusted without turning the outboard motor body 30 with respect to the hull 11, so that energy required for turning can be reduced.

The mounting portion 40 is fixed to the rear end of the hull 11. The mounting portion 40 supports the outboard motor body 30 via the operation mechanism 50.

The operation mechanism 50 is a link-type operation mechanism including a hydraulic cylinder 50C as an actuator. The ECU 32 operates the hydraulic cylinder 50C based on the outputs of the power tilt switch 16 and the power trim switch 17.

The operation mechanism 50 includes, in addition to the hydraulic cylinder 50C, an upper link 50U, a lower link 50L, a sub link 50S, an upper link restricting portion 51, and a sub link restricting portion 52.

One end portion 50Ua of the upper link 50U is rotatably fixed to the outboard motor body 30, and the other end portion 50Ub thereof is rotatably fixed to the mounting portion 40. An upper end portion 50Ca of the hydraulic cylinder 50C is rotatably fixed between the one end portion 50Ua and the other end portion 50Ub of the upper link 50U.

The lower link 50L is disposed below the upper link 50U, one end portion 50La thereof is rotatably fixed to the outboard motor body 30, and the other end portion 50Lb thereof is rotatably fixed to a movable supporting point 53.

One end portion 50Sa of the sub link 50S is rotatably fixed to the movable supporting point 53, and the other end portion 50Sb is rotatably fixed to a lower end portion 50Cb of the hydraulic cylinder 50C. In addition, an intermediate portion 50Sc positioned between the one end portion 50Sa and the other end portion 50Sb of the sub link 50S is rotatably fixed to the mounting portion 40. In the sub link 50S of the present embodiment, a first sub link 55 and a second sub link 56 intersect each other in an L shape at the intermediate portion 50Sc so that they cannot rotate relative to each other. The sub link 50S includes the one end portion 50Sa on the first sub link 55 on an opposite side to the intermediate portion 50Sc and the other end portion 50Sb on the second sub link 56 on an opposite side to the intermediate portion 50Sc. The sub link 50S may include, for example, a plate-shaped member including the one end portion 50Sa, the intermediate portion 50Sc, and the other end portion 50Sb as vertices of a triangle.

The upper link restricting portion 51 is provided above the upper link 50U. The upper link restricting portion 51 contacts the upper link 50U to restrict a movement of the upper link 50U above a predetermined area. The upper link restricting portion 51 is preferably a movable member that can optionally adjust a contact position with respect to the upper link 50U.

The sub link restricting portion 52 is provided below the sub link 50S. The sub link restricting portion 52 contacts the sub link 50S to restrict a movement of the sub link 50S below a predetermined area.

As described above, the operation mechanism 50 includes only one hydraulic cylinder 50C as an actuator, and is realized by a small number of components including the hydraulic cylinder 50C (in this example, a total of four points of the hydraulic cylinder 50C, the upper link 50U, the lower link 50L, and the sub link 50S).

Next, an operation of the outboard motor 20 configured as described above will be described.

As shown in FIG. 2, in the full tilt-down state, the outboard motor 20 is most lowered with respect to the hull 11. At this time, the hydraulic cylinder 50C is most contracted.

Figure 3:
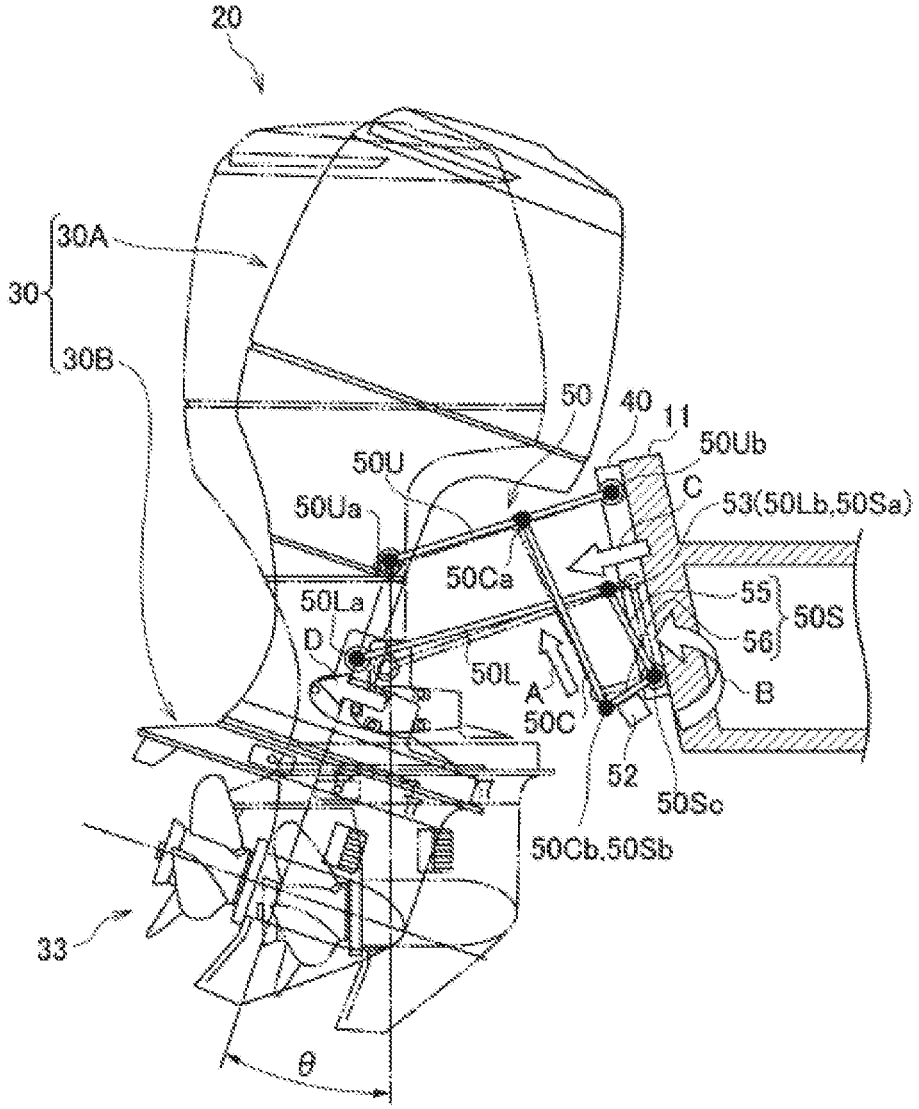
FIG. 3 is a side view of the outboard motor shown in FIG. 2 during a trim-up operation when the outboard motor is stopped.

As shown by an arrow A in FIG. 3, when the hydraulic cylinder 50C is extended from the fully tilt-down state of FIG. 2 while the boat 10 is stopped, as shown in FIG. 3, the sub link 50S rotates in a direction of an arrow B (counterclockwise) with the intermediate portion 50Sc as a fulcrum, and the lower link 50L is pushed out in a direction away from the mounting portion 40 (direction of an arrow C) while the upper link 50U is substantially stopped. As a result, the outboard motor body 30 is rotated in a direction of an arrow D (clockwise), that is, trimmed up, and a tilt trim angle θ increases. At a time point when the tilt trim angle θ reaches an upper limit of a trim area, the sub link 50S comes into contact with the sub link restricting portion 52, and a downward movement of the sub link 50S is restricted.

Figure 4:
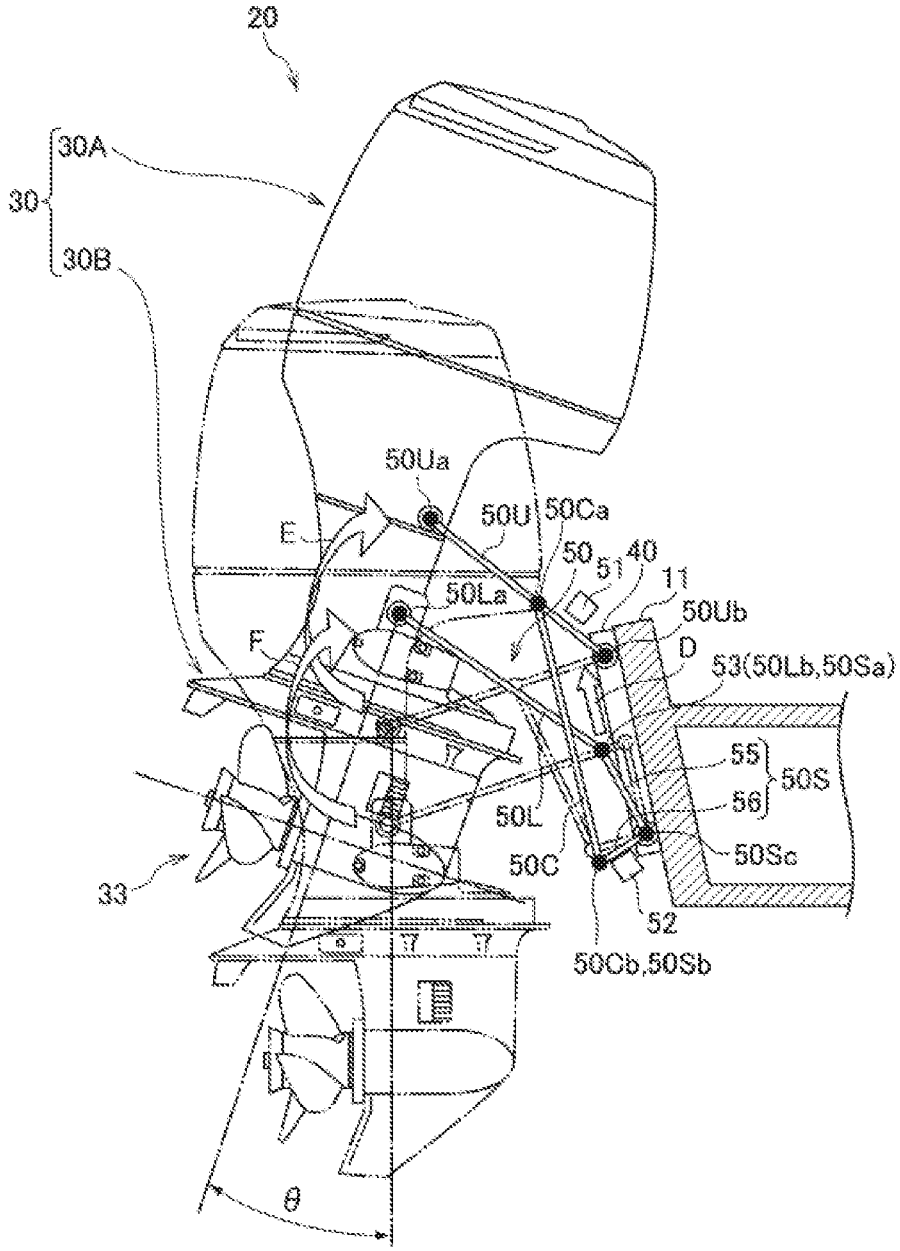
FIG. 4 is a side view of the outboard motor shown in FIG. 2 in a full tilt-up state.

When the hydraulic cylinder 50C is further extended from this state as shown by an arrow D in FIG. 4, as shown in FIG. 4, the upper link 50U rotates in a direction of an arrow E (counterclockwise) with the other end portion 50Ub as a fulcrum, and the lower link 50L rotates in a direction of an arrow F (counterclockwise) with the movable supporting point 53 as a fulcrum. As a result, the outboard motor body 30 moves upward with respect to the hull 11. Then, at a time point when the upper link 50U comes into contact with the upper link restricting portion 51 and the hydraulic cylinder 50C extends to the maximum extent, the outboard motor 20 is in the full tilt-up state.

Figure 5:
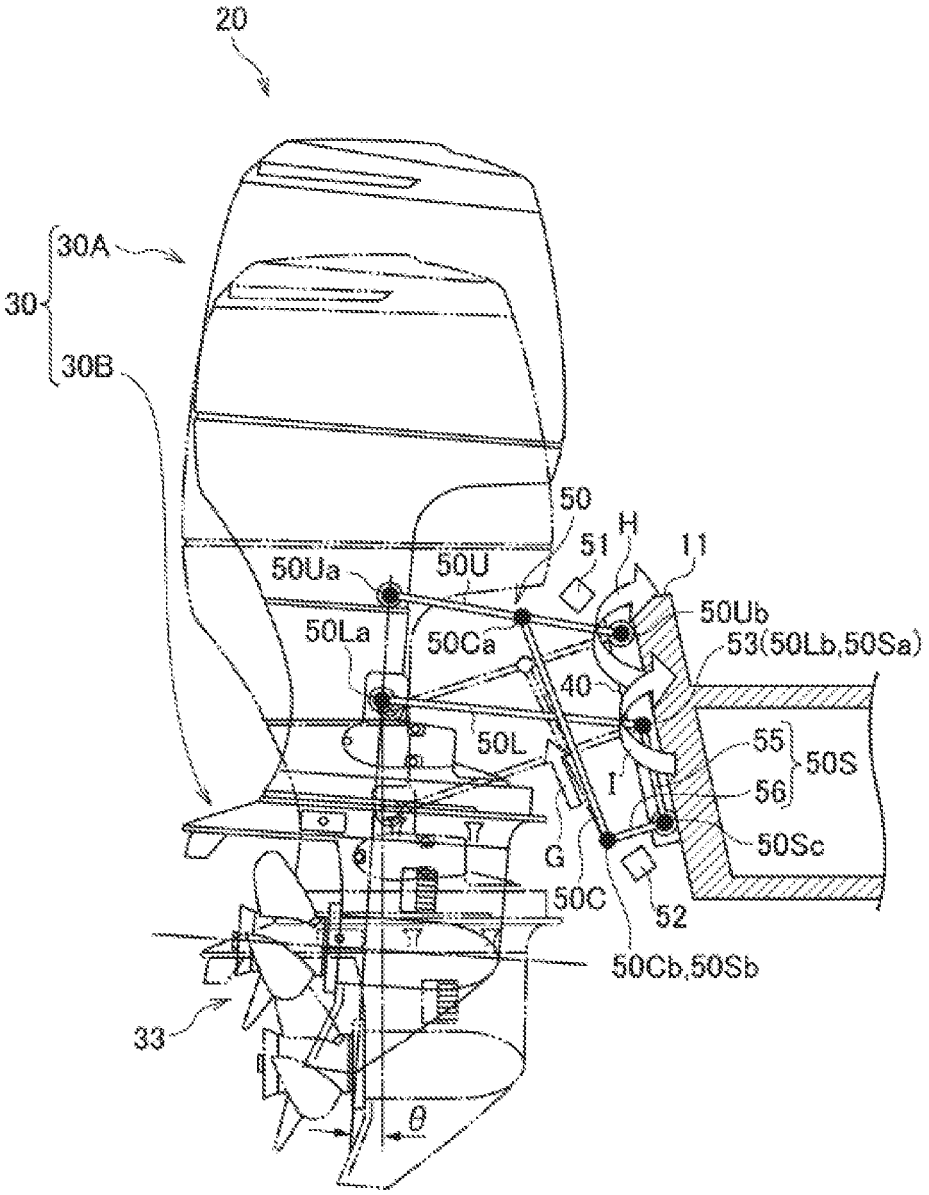
FIG. 5 is a side view of the outboard motor shown in FIG. 2 during the trim-up operation when the outboard motor is traveling.

On the other hand, as shown by an arrow G in FIG. 5, when the hydraulic cylinder 50C is extended from the fully tilt-down state of FIG. 2 while the boat 10 is traveling, since a moment due to a thrust force of the propeller 33 acts on the outboard motor body 30, as shown in FIG. 5, the upper link 50U rotates in a direction of an arrow H (clockwise) with the other end portion 50Ub as a fulcrum, and the lower link 50L rotates in a direction of an arrow I (clockwise) with the movable supporting point 53 as a fulcrum, with the movable supporting point 53 stopped without separating from the mounting portion 40. As a result, the outboard motor body 30 moves upward with respect to the hull 11 with almost no change in posture, that is, the tilt trim angle θ remains substantially constant.

The embodiment described above can be appropriately modified, improved, or the like.

For example, although only one hydraulic cylinder 50C is provided in the operation mechanism 50 in the embodiment described above, two or more hydraulic cylinders 50C may be arranged in parallel. That is, the present invention does not exclude an operation mechanism including two or more hydraulic cylinders 50C.

At least the following matters are described in the present specification. Although the corresponding constituent elements or the like in the above-described embodiment are shown in parentheses, the present invention is not limited thereto.

(1) An outboard motor (outboard motor 20) including:

an outboard motor body (outboard motor body 30) including a propeller (propeller 33) driven by an internal combustion engine (internal combustion engine 31);

a mounting portion (mounting portion 40) configured to mount the outboard motor body to a hull (hull 11) so as to be movable relative to the hull (hull 11); and an operation mechanism (operation mechanism 50) provided between the outboard motor body and the mounting portion and configured to adjust a relative position of the outboard motor body with respect to the hull, wherein the operation mechanism is a link-type operation mechanism including an actuator (hydraulic cylinder 50C).

According to (1), since the operation mechanism configured to adjust the relative position of the outboard motor body with respect to the hull is the link-type operation mechanism, the number of actuators can be reduced.

(2) The outboard motor according to (1), wherein the link-type operation mechanism includes an upper link (upper link 50U) including one end portion (one end portion 50Ua) rotatably fixed to the outboard motor body and another end portion (the other end portion 50Ub) rotatably fixed to the mounting portion, an upper end portion (upper end portion 50Ca) of the actuator being rotatably fixed between the one end portion and the other end portion, a lower link (lower link 50L) disposed below the upper link, and including one end portion (one end portion 50La) rotatably fixed to the outboard motor body and another end portion (the other end portion 50Lb) rotatably fixed to the movable supporting point (movable supporting point 53), and a sub link (sub link 50S) including one end portion (one end portion 50Sa) rotatably fixed to the movable supporting point, another end portion (the other end portion 50Sb) rotatably fixed to a lower end portion (lower end portion 50Cb) of the actuator, and an intermediate portion (intermediate portion 50Sc), which is located between the one end portion and the other end portion, rotatably fixed to the mounting portion.

According to (2), the link-type operation mechanism can be realized with a limited number of components.

(3) The outboard motor according to (2), wherein the link-type operation mechanism includes an upper link restricting portion (upper link restricting portion 51) that contacts the upper link to restrict an upward movement of a predetermined area, and a sub link restricting portion (sub link restricting portion 52) that contacts the sub link to restrict a downward movement of a predetermined area.

According to (3), the upper link restricting portion and the sub link restricting portion can appropriately restrict the relative position of the outboard motor body with respect to the hull.

(4) The outboard motor according to any one of (1) to (3), further including:

a propeller position adjustment mechanism (propeller position adjustment mechanism 34) configured to adjust a relative position of the propeller with respect to the hull.

According to (4), since it is not necessary to rotate the outboard motor body at the time of turning, energy required for the turning can be reduced.

REFERENCE SIGNS LIST

11 hull
20 outboard motor
30 outboard motor body
31 internal combustion engine
33 propeller
34 propeller position adjustment mechanism
40 mounting portion
50 operation mechanism (link-type operation mechanism)
50C hydraulic cylinder (actuator)
50Ca upper end portion
50Cb lower end portion
50L lower link
50La one end portion
50Lb the other end portion
50U upper link
50Ua one end portion
50Ub the other end portion
50S sub link
50Sa one end portion
50Sb the other end portion
50Sc intermediate portion
51 upper link restricting portion
52 sub link restricting portion
53 movable supporting point

The invention claimed is:

1. An outboard motor comprising:

an outboard motor body including a propeller driven by an internal combustion engine;

a mounting portion configured to mount the outboard motor body to a hull so as to be movable relative to the hull; and an operation mechanism provided between the outboard motor body and the mounting portion and configured to adjust a relative position of the outboard motor body with respect to the hull, wherein the operation mechanism is a link-type operation mechanism including an actuator, and wherein the link-type operation mechanism includes:

an upper link including one end portion rotatably fixed to the outboard motor body and another end portion rotatably fixed to the mounting portion, an upper end portion of the actuator being rotatably fixed between the one end portion and the other end portion, a lower link disposed below the upper link, and including one end portion rotatably fixed to the outboard motor body and another end portion rotatably fixed to a movable supporting point, and a sub link including one end portion rotatably fixed to the movable supporting point, another end portion rotatably fixed to a lower end portion of the actuator, and an intermediate portion, which is located between the one end portion and the other end portion, rotatably fixed to the mounting portion.

2. The outboard motor according to claim 1, wherein the link-type operation mechanism includes:

an upper link restricting portion that contacts the upper link to restrict an upward movement of a predetermined area, and a sub link restricting portion that contacts the sub link to restrict a downward movement of a predetermined area.

3. The outboard motor according to claim 1, further comprising:

a propeller position adjustment mechanism configured to adjust a relative position of the propeller with respect to the hull.

* * * * *